US005984639A

United States Patent [19]

Gekht et al.

[11] Patent Number: 5,984,639

[45] Date of Patent: Nov. 16, 1999

[54] BLADE RETENTION APPARATUS FOR GAS TURBINE ROTOR

[75] Inventors: Eugene Gekht, Brossard; Valerio Valentini, Montreal, both of Canada

[73] Assignee: Pratt & Whitney Canada Inc., Longueuil, Canada

[21] Appl. No.: 09/112,228

[22] Filed: Jul. 9, 1998

[51] Int. Cl.[6] ..... B63H 1/20; F01D 5/30; F16B 19/00

[52] U.S. Cl. ..... 416/220 R; 29/889.21; 411/361; 411/399

[58] Field of Search ..... 416/219 R, 220 R, 416/248; 411/361, 354, 399; 29/889.21

[56] References Cited

U.S. PATENT DOCUMENTS

| | | | |
|---|---|---|---|
| 905,487 | 12/1908 | Worsey | 416/220 R X |
| 980,732 | 1/1911 | Anderson | 416/220 R X |
| 1,109,998 | 9/1914 | Loewenstein | 416/220 R X |
| 1,998,951 | 4/1935 | Downer | 416/220 R X |
| 3,371,572 | 3/1968 | King, Jr. | 411/361 |
| 3,395,891 | 8/1968 | Burge et al. | 416/220 R X |
| 4,202,242 | 5/1980 | Champoux et al. | 411/361 |
| 4,324,518 | 4/1982 | Dixon | 411/361 |
| 4,343,594 | 8/1982 | Perry | 416/220 R X |
| 4,505,640 | 3/1985 | Hsing et al. | 416/219 R X |
| 4,797,065 | 1/1989 | Conlow | 416/220 R X |
| 4,995,777 | 2/1991 | Warmington | 411/361 |
| 5,727,927 | 3/1998 | Luxenburger | 416/220 R X |
| 5,749,706 | 5/1998 | Maar | 416/220 R X |

*Primary Examiner*—John E. Ryznic
*Attorney, Agent, or Firm*—Jeffrey W. Astle

[57] ABSTRACT

The present invention relates to a blade retention apparatus for a bladed rotor in a turbine section of a gas turbine engine which comprises a rivet grip which has serration at one end and an upset head at the other end, and a sleeve made of a soft metal which is compressed to the serration actually against the surfaces of the disk and the blade. The retention apparatus of the present invention provides a reliable attachment and only requires a simple hand-held pneumatic riveting tool to install.

9 Claims, 2 Drawing Sheets

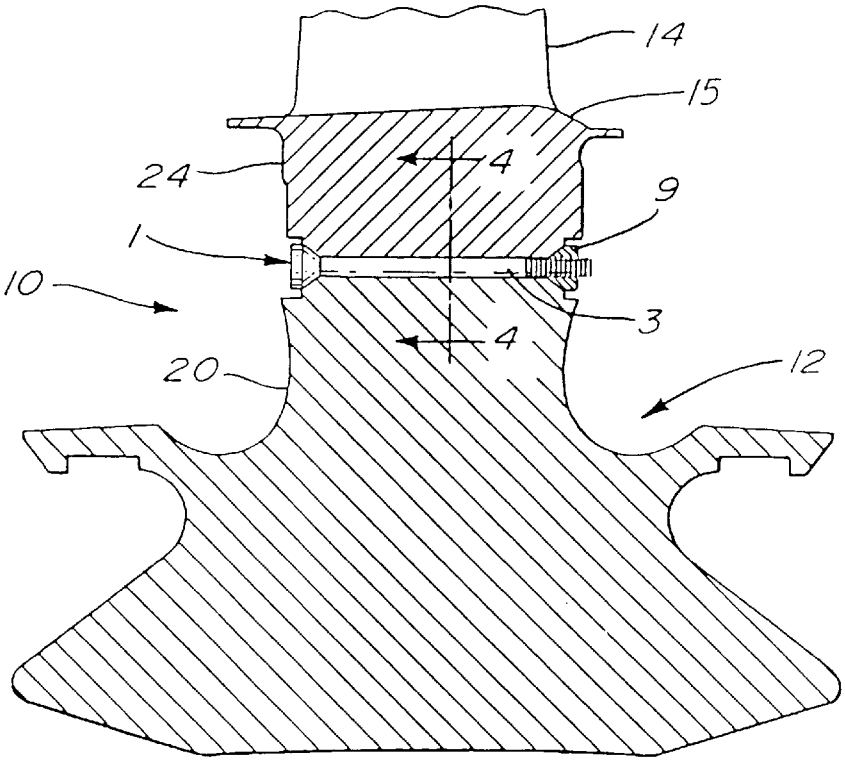
Fig. 3
Fig. 4
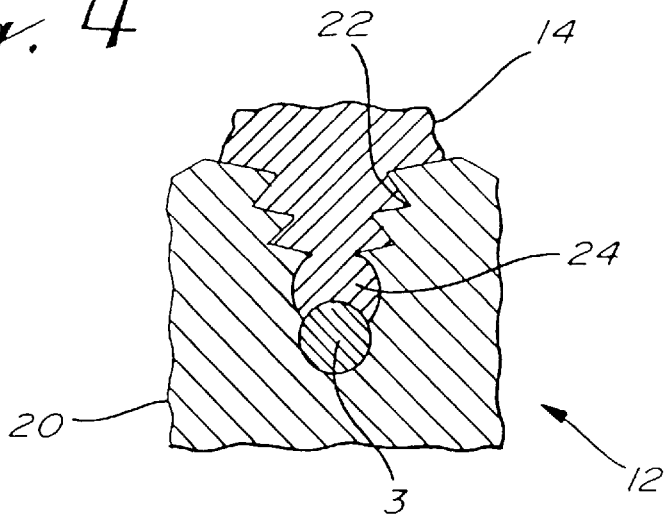

BLADE RETENTION APPARATUS FOR GAS TURBINE ROTOR

BACKGROUND OF THE INVENTION (a) Field of the Invention

The present invention relates to gas turbine engines, and more particularly, to a turbine rotor and an improved blade retention apparatus.

(b) Description of the Prior Art

Turbine rotors are normally constructed with a plurality of individual airfoil rotor blades mounted to the periphery of a rotor disc. Each airfoil blade includes a root that slides into an individual slot formed in the periphery of the disc. In commercial and most military gas turbine engines, it is customary to have individual turbine blades attached to the disc through the use of serrated slots which restrain the blades in the radial and generally tangential directions. In the axial direction however, a separate means of restraint must be provided. For example, the use of a one-piece rivet with a pre-fabricated head at one end and a hollow opposite end which is flared after the blade is commonly used.

Such a method of blade retention presents numerous disadvantages. There have been instances where the rivets have not provided sufficient resistance to the axial loads imparted by the blades and have been allowed to slip out of their serrations and rub against adjacent components. This phenomenon can be attributed to the relatively weak structure which constitutes the flared end of the rivet and due to the assembly process which places the rivet in a residual compression. Attempts to improve the blade retention have resulted in a variety of riveting methods. An orbital riveting machine was introduced to install rivets to the blades. This machine is large, complicated and expensive. Another method that was introduced included placing a hollow rivet by a solid stem with a conical collar inserted at the end of the rivet which was subsequently set with a hydraulic press. This method, although useful, introduced an installation technique which was three times longer than the previously used method.

SUMMARY OF THE INVENTION

It is an aim of the present invention to provide a blade retention apparatus that provides a reliable attachment and only requires a simple hand-held pneumatic riveting tool to install.

It is also an aim of the present invention to provide a blade retention apparatus which utilizes existing materials.

A construction in accordance with the present invention comprises a bladed rotor for a gas turbine comprising a rotor having an axis of rotation, the rotor including a disc having an annular rim with radial slots defined in the rim and blades mounted to the rotor with each blade comprising an air foil, a blade platform, and a root inserted in a respective slot, the bladed rotor further comprising a blade retention means extending in interference between the root of the blade and a wall of the slot of the rotor, the blade retention apparatus comprising:

a metal shank which has serrations at one end and an upset head at the other end; and a metal retainer which is compressed onto the serration axially against the surfaces of the disk and the blade.

A method in accordance with the present invention comprises a method for installing a blade in a bladed rotor for a gas turbine comprising a rotor having an axis of rotation, the rotor including a disc having an annular rim, each blade comprising an air foil, a blade platform, and a root to be inserted in a respective slot in the disc, the method comprising the steps of:

(a) inserting the root of the blade in the respective slot of the disc;

(b) inserting a metal shank which has serrations at one end and an upset head at the other end in interference between the root of the blade and the slot of the rotor;

(c) inserting a metal retainer onto the serrations of the end of the metal shank; and (d) applying a force to the metal retainer to simultaneously pull the shank tight and force the metal retainer axially against the surfaces of the disc and the blade.

BRIEF DESCRIPTION OF THE DRAWINGS

Having thus generally described the nature of the invention, references will now be made to the accompanying drawings, showing by way of illustration a preferred embodiment thereof and in which

FIG. 3 is a axial cross-sectional view taken through a typical bladed turbine assembly of a gas turbine engine showing an embodiment of the present invention; and FIG. 4 is an enlarged fragmentary cross-sectional view taken on lines 4/4 of FIG. 3.

DESCRIPTION OF THE PREFERRED EMBODIMENTS

Figure 1:
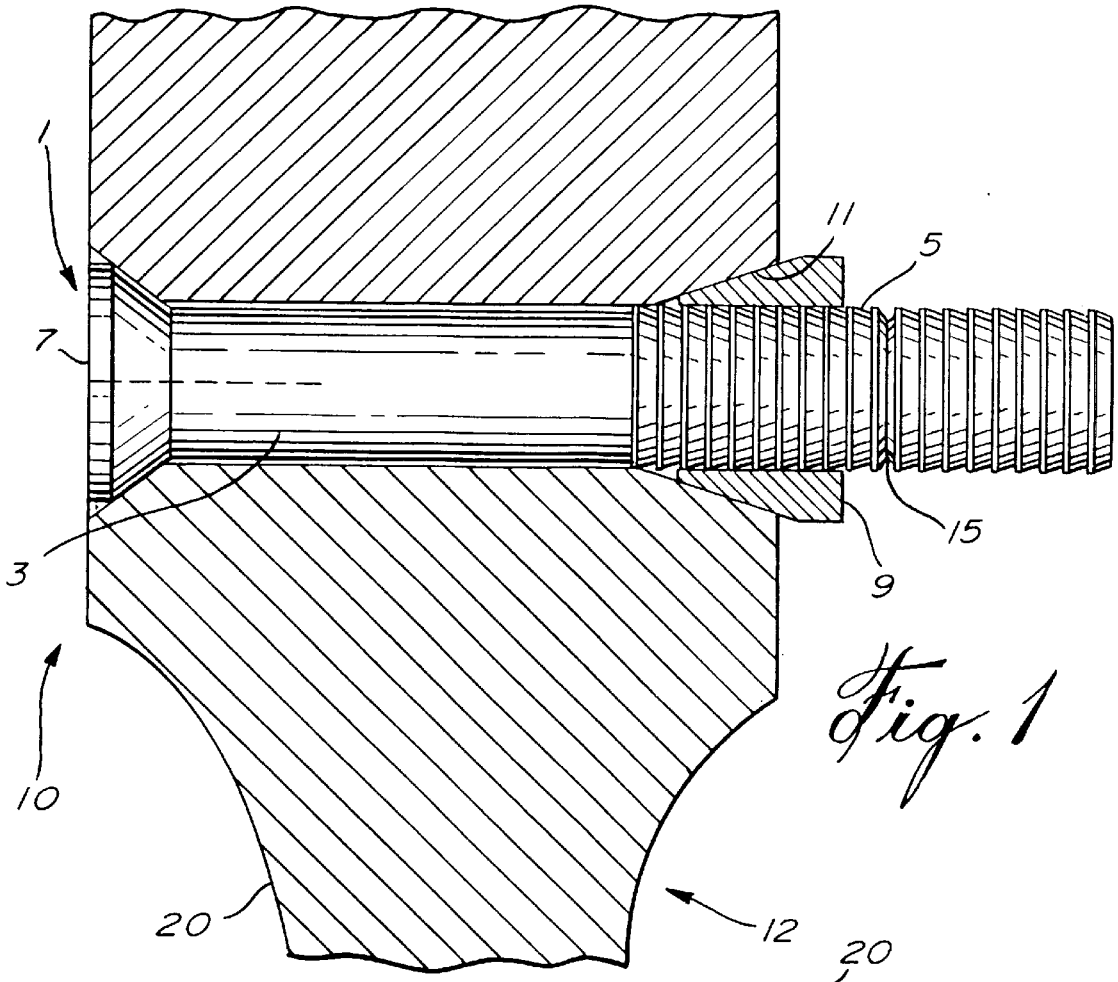
FIG. 1 is an axial cross-sectional view taken through a typical blade for gas turbine engine, showing an embodiment of the present invention before installment.

Referring now to the drawings, and in particular, to FIGS. 1 and 3, there is shown a portion of a turbine blade 10 for a gas turbine engine, in which a rotor 12 is shown in axial cross-section. The rotor 12 includes a disk rim 20 to which a plurality of radially extended blades is mounted. Typically, each blade 10 has an airfoil 14, a blade platform 15, and a root 24 which is inserted in a slot 22 formed in the disk rim 20.

The blade retention apparatus 1 consists of a metal shank 3 which has circumferential serrations 5 at one end and a upset head 7 at the other end. A metal sleeve 9 is compressed onto the serrations 5. The disk 20 is provided with countersunk, conical cavities 11 which are adapted to receive the metal sleeve 9 having a similar conical shape.

Figure 2:
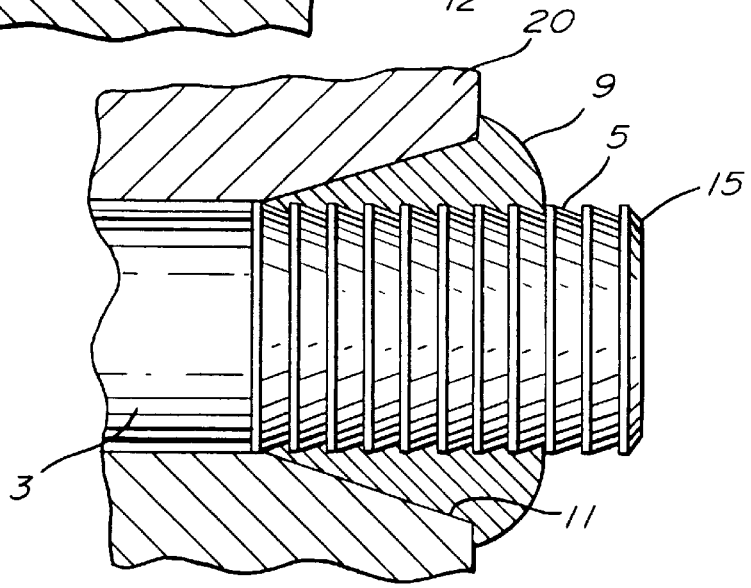
FIG. 2 is a fragmentary enlarged cross-sectional view showing part of the shank that has been broken at a prescribed location after installment.

Preferably, the metal shank 3 is provided with a single deeper serration 15 beyond the area where the sleeve 9 is installed. The single deeper serration 15 becomes the prescribed location where the shank 3 will break after the sleeve 9 has been correctly installed. FIG. 2 shows the metal shank 3 after it has been broken at the prescribed location 15.

Thus, as can be seen, the metal sleeve 9 is installed over the circumferential serrations 5 of the metal shank 3. The metal sleeve 9 is compressed onto the serrations 5 with a hand-held tool to simultaneously pull the shank 3 tight and to force the metal sleeve 9 axially against the countersunk surfaces 11 in the disk 20 and blade 14. After the sleeve 9 has been correctly installed, the single deeper serration 15 is broken at the prescribed location.

As shown on FIGS. 3 and 4, the blade retention apparatus 1 is normally provided, extending through the disc rim 20 and generally at the interference between the root 24 and the material of disc rim 20. The blade retention apparatus 1 anchors the blade 14 in the disc 20 of the rotor 12.

The sleeve 9 is preferably made of ductile metal. Preferably, the ductile metal can resist high temperature. More preferably, the ductile metal is a nickel based alloy. Most preferably, the ductile metal is Inco 600™.

The shank 3 is preferably a rivet. More preferably, the shank 3 is a Cherry™ Rivet grip.

We claim:

1. In a bladed rotor for a gas turbine comprising a rotor having an axis of rotation, the rotor including a disc having an annular rim with a plurality of spaced-apart slots extending in the direction of the axis of rotation and blades mounted to the rotor with each blade comprising an air foil, a blade platform, and a root inserted in a respective slot, the bladed rotor further comprising a blade retention apparatus extending in interference between the root of the blade and the rim at the slot of the rotor, the disc being provided with countersunk cavities associated with each slot, the blade retention apparatus comprising:

a metal shank which has circumferential serrations at one end and an upset head at the other end; and a metal retainer of ductile metal compressed onto the serrations axially within a respective countersunk cavity of the disc and the blade.

2. In the bladed rotor in accordance with claim 1, wherein said metal retainer is a conical sleeve.

3. In the bladed rotor as defined in claim 1, the metal shank with serrations comprises at least one deeper serration beyond the area where the sleeve is installed for the shank to break when a force is applied after the sleeve has been installed.

4. In the bladed rotor as defined in claim 1 wherein said ductile metal is a nickel based alloy.

5. In the bladed rotor as defined in claim 4 wherein said ductile metal is Inco 600™.

6. In the bladed rotor as defined in claim 5, wherein the shank is a rivet.

7. In the bladed rotor as defined in claim 5, wherein the shank is a Cherry™ rivet grip.

8. A method for retaining a blade in a bladed rotor for a gas turbine comprising a rotor having an axis of rotation, the rotor including a disc having an annular rim with a plurality of spaced-apart slots extending in the direction of the axis of rotation, each blade comprising an air foil, a blade platform, and a root to be inserted in a respective slot in the disc, the disc including countersunk cavities associated with the slots, the method comprising the steps of:

(a) inserting the root of the blade in the respective slot of the disc;

(b) inserting a metal shank which has serrations at one end and an upset head at the other end in interference between the root of the blade and the slot of the rotor;

(c) inserting a metal retainer in the form of a sleeve made of ductile metal onto the serrations of the end of the metal shank; and (d) applying a force to the metal retainer to simultaneously pull the shank tight and compress the metal retainer axially within the corresponding cavity of the disc and the blade.

9. The method of claim 8, wherein at least one serration is formed deeper in the shank than the remainder of the serrations in an area beyond the sleeve when installed, and including the further step of breaking the shank at the location of the deeper serration by applying force to the shank after the sleeve has been installed.

* * * * *